United States Patent [19]

Schnell

[11] Patent Number: 4,534,124

[45] Date of Patent: Aug. 13, 1985

[54] SPRING-ACTION RUNNING AND JUMPING SHOE

[76] Inventor: Joachim Schnell, Amselweg 7, D-6348 Herborn 4, Fed. Rep. of Germany

[21] Appl. No.: 531,612

[22] Filed: Sep. 12, 1983

[30] Foreign Application Priority Data

Sep. 14, 1982 [EP] European Pat. Off. ..... 82108456.3

[51] Int. Cl.[3] ..... A43B 13/18; A43B 5/06

[52] U.S. Cl. ..... 36/114; 36/28; 36/7.8; 272/114

[58] Field of Search ..... 36/27, 28, 29, 102, 36/114, 7.8; 272/114, 96

[56] References Cited

U.S. PATENT DOCUMENTS

| | | | |
|---|---|---|---|
| 75,900 | 3/1868 | Hale et al. | 36/28 |
| D. 194,309 | 1/1963 | Levine | 36/7.8 |
| 427,136 | 5/1890 | Walker | 36/28 |
| 871,864 | 11/1907 | Feazell et al. | 272/114 |
| 1,693,911 | 12/1928 | Schmeer | 36/28 |
| 2,172,000 | 9/1939 | Wenker | 36/7.8 |
| 3,036,389 | 5/1962 | Wesch | 36/7.8 |
| 4,196,903 | 4/1980 | Illustrato | 272/114 |
| 4,360,978 | 11/1982 | Simpkins | 36/114 |

FOREIGN PATENT DOCUMENTS

| | | | |
|---|---|---|---|
| 2424889 | 12/1975 | Fed. Rep. of Germany | 36/102 |
| 487779 | 7/1918 | France | 36/28 |
| 891679 | 3/1944 | France | 36/28 |
| 377897 | 8/1932 | United Kingdom | 36/29 |

*Primary Examiner*—Werner H. Schroeder
*Assistant Examiner*—Steven N. Meyers
*Attorney, Agent, or Firm*—Ostrolenk, Faber, Gerb & Soffen

[57] ABSTRACT

An athletic shoe, particularly for running and jumping, including an upper sole, a separate lower sole beneath the upper sole and a leaf spring of approximately the width of the shoe connecting the upper and lower soles. One end of the leaf spring is fastened to one end of the upper sole, such as the front end, while the other end of the leaf spring is fastened to the opposite end of the lower sole. The opposite surfaces of the upper and lower soles facing the spring may be arcuately curved. The spring may be arcuately curved. The upper sole may be fastened to the shoe over the entire length of the upper sole or only at the front of the shoe, e.g. at a joint. Additional springs may be disposed between the upper and lower soles.

10 Claims, 7 Drawing Figures

SPRING-ACTION RUNNING AND JUMPING SHOE

BACKGROUND OF THE INVENTION

The present invention relates to a spring-action running and jumping shoe having an upper sole and a lower sole which are connected elastically to each other.

Man's running and jumping capabilities are increased by shoes having elastic soles. For high jumps, a large spring path and large spring force are advantageous, as in trampoline jumping. Spring-action running and jumping shoes of relatively large spring path and large spring force can be used for athletic running and jumping, for jogging and for a jumping sport similar to trampoline jumping.

Many embodiments of spring-action running and jumping shoes are known. In this connection, different types of springs are used, such as coil compression springs, tension springs, leaf springs, rubber and foam-rubber cushions and pneumatic springs. With a spring path of several centimeters, the exact guidance of the lower sole which contacts the ground upon running is a problem. Expensive devices have been described in order to make certain that breaking out of the spring toward the side or toward the front and rear is prevented. When wide leaf springs or similar structural parts are used, the guidance problem is solved. Thus, German Utility Model No. 7701451 describes an embodiment which contains a leaf spring, the front half of which is developed as the outer sole, while its rear end is fastened to the rear end of the upper sole. This embodiment makes it possible upon running to improve the take-off by means of the spring force shortly before the lifting off of the foot. But, one cannot take up the momentum upon placing the heel of the foot down and use it again for the forward drive.

The opposite is true in the case of a V-shaped base fastened below the running show with its point forward, as described in German DE-OS No. 24 24 889. Upon running, the push of the heel is taken up thereby and is converted into an upward and forward thrust. The take-off is not improved thereby, since no spring action is present any longer in this position.

Both of the embodiments described furthermore have the disadvantage that only a part of the leaf spring can fully develop its spring action since it is developed in part as the outer sole. A spring calculation shows that the permissible strength values of spring steel are rapidly exceeded if it is attempted to take up with these springs the spring forces which correspond to several times the weight of the body.

From the above description it is clear that it is advantageous for a spring-action running and jumping shoe to contain two spring actions. The first spring action takes up the upward thrust when the heel is placed down and converts it into an upward and forward thrust during the course of the rolling motion of the foot. The second spring action improves the take-off with the tip of the foot. One complicated device for converting the thrust of the heel into forward thrust is described in DE-OS No. 30 12 945. Simpler embodiments having two springs are described in DE No. 30 17 769A1 and DE No. 30 34 126A1. The latter patent application also contains an embodiment having two leaf springs curved in S shape, wherein one spring is fastened to the front end and one to the rear end of the shoe. The two loose ends of the leaf springs form the outer sole. At least one of the two springs must be divided in two, for reasons of symmetry. Since the width of the shoe is not more than 10 cm, this results in relatively narrow leaf springs of only slight lateral stability. During running, such running shoes therefore tend to move out toward the side or to tilt. They have the further disadvantage that the spring action of the leaf springs is only partly utilized. Therefore, large forces cannot be taken up due to the limited strength of the material.

SUMMARY OF THE INVENTION

The object of the invention is to develop a spring-action running and jumping shoe having one spring action in the region of the heel and a second spring action in the region of the front of the foot and also having good forward, rearward and lateral stability and which, with a spring path of several centimeters, takes up by spring action forces which correspond to several times the weight of the body.

In accordance with the invention, the elastic connection between the upper and lower soles of a spring-action running and jumping shoe comprises a leaf spring of approximately the width of the shoe. One end of the spring is fastened to the front or to the rear part of the upper sole and the other end is fastened to the opposite part of the lower sole. In the preferred embodiment, the leaf spring is attached to the front end of the upper sole and to the rear end of the lower sole.

To improve the spring action and so that the spring may rest against one or both of the soles in case of strong loading, either one or both of the underside of the upper sole or the upper side of the lower sole, both of which face the spring, are at least partially arched or support upon themselves arched ribs against which the spring is pressed upon loading.

In an alternate embodiment, the spring itself is curved in arcuate shape along the length. With one or both of the leaf spring or the soles, the arcuate shape of the soles and/or of the leaf spring has a constant curvature.

In a further alternate embodiment, rather than the entire upper sole being attached to the athletic shoe and that, in turn, being attached to the spring at one end of the upper sole, only the front part of the shoe is firmly attached to the upper sole. This permits the foot to tilt forwardly to a great extent. The attachment of the shoe to the upper sole may be at pivoting joint located, for instance, at the front of the shoe, as in a cross-country ski boot connection to the ski.

Alternate additional springs at the front and/or rear of the shoe may be provided, e.g. separate pneumatic springs, which cooperate with the leaf spring to provide the correct lift.

The invention is briefly described by looking at the process of running, using shoes in accordance with the invention. The leaf spring is flat in the unloaded condition. When the heel is set down, the leaf spring is curved in one direction and, upon pushing off with the tip of the foot, it is curved in the other direction (FIGS. 2 and 4). As a result, with only a single leaf spring, two spring actions are obtained, one in the region of the heel and one in the region of the front of the foot. During running, after the heel has been set down and before pushing off with the tip of the foot, the foot effects a rolling movement, which is supported by the spring which is now curved in S shape. This curvature is caused by the heel pressure initially predominating and then by the front of the foot predominating subsequently. The energy stored in the leaf spring by the placing down of the heel is converted, during the rolling process, into an upward and forward thrust. Toward the end of the rolling process, this energy is consumed and the leaf spring is now tensioned only by the action of the front of the foot. The energy stored in the leaf spring by the strong pushing-off motion of the front of the foot is converted into an additional forward and upward thrust when the muscular work has already ceased and the leg is stretched straight.

By the spring-action running and jumping shoe of the invention, the efficiency of the running process is substantially improved and easier and faster running and higher and longer jumping are possible. By the use of leaf springs which utilize the entire width of the shoe or even somewhat more, good forward, rearward and lateral stability is obtained, even in the case of spring paths of several centimeters. Only a little practice is necessary to achieve dependable running and jumping with the shoe of the invention.

One advantage over the prior art is the utilization of the spring action of one leaf spring in two directions, rather than using two springs. As a result, with the same spring action and the same stressing of material, the weight of the spring and the required spring space are reduced by half. Only by this technique is it possible when using leaf springs of high-grade spring steel to take up, with relatively large spring paths, forces which correspond to a multiple of the weight of the body without so increasing the base surface of the shoe or the weight of the shoe that running or jumping is impeded. It is a particular advantage over the prior art that the good properties of spring-action running and jumping shoes in accordance with the invention are obtained at only slight technical expense.

The invention will be described in further detail below with reference to four illustrative embodiments.

BRIEF DESCRIPTION OF THE DRAWING FIGURES

DESCRIPTION OF THE PREFERRED EMBODIMENTS

EXAMPLE 1

Figure 1:
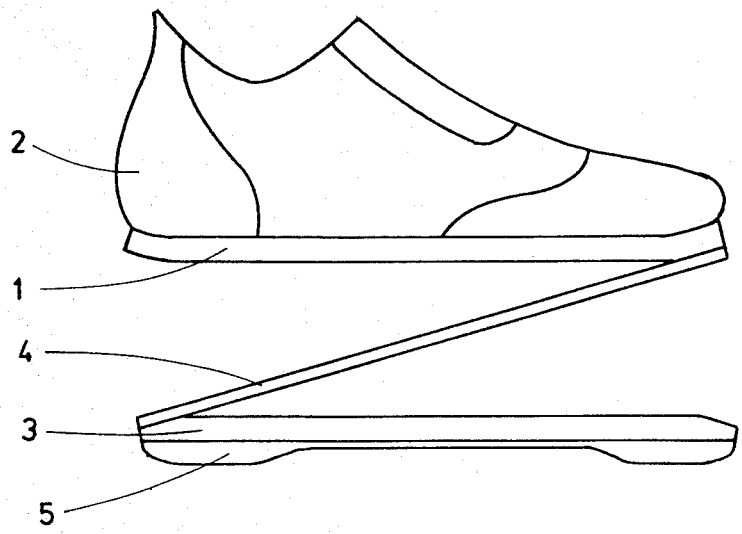
FIG. 1 is a side elevational view of an athletic shoe provided with the present invention and not under load.

FIG. 1 shows the construction, in principle, of a spring-action running and jumping shoe according to the invention. A substantially rigid upper sole 1 forms the shoe sole of an athletic shoe 2 which surrounds the foot. However, only a substantially rigid lower sole 3, which is connected via a wide leaf spring 4 to the upper sole 1, contacts the ground. One end of the leaf spring 4 is connected to the front part of the upper sole 1, and the other end of the leaf spring 4 is connected to the rear part of the lower sole 3. The lower sole 3 contains a running covering 5, such as a profiled sole, rubber cleats, spikes or similar devices for improving adherence to the ground at the places where the lower sole touches the ground during running. The width of the leaf spring 4 generally corresponds to the width of the shoe, although it may also be somewhat wider or narrower than it.

Figure 2:
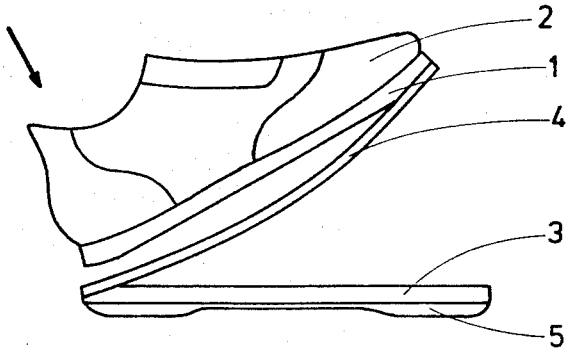
FIG. 2 is the same view of the shoe when the foot first contacts the ground and the heel is closer to the ground than the toe.
Figure 3:
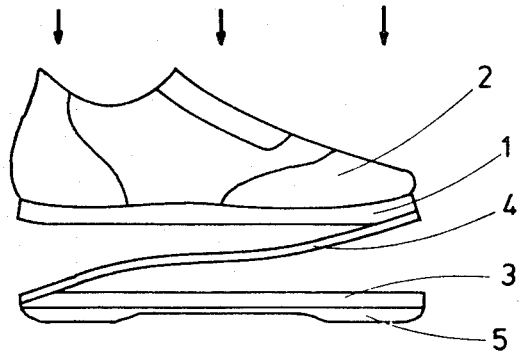
FIG. 3 shows the same shoe as the foot is now rolling forward.
Figure 4:
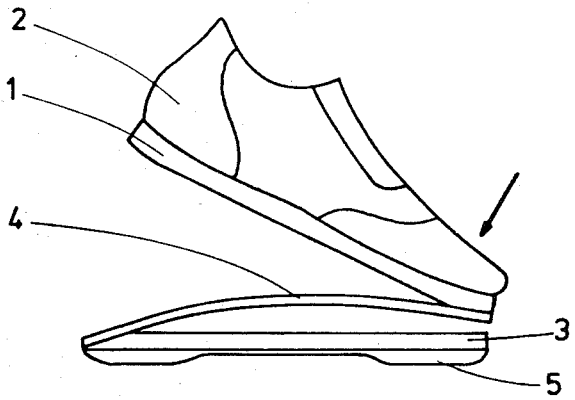
FIG. 4 shows the shoe when the foot is is about to leave the ground, with the foot tilted forwardly and the toe is closer to the ground than the heel.

The changes occurring during running are now described. FIG. 2 shows how the leaf spring 4 bends when a load is placed on the heel. Upon uniform vertical loading of the foot, the spring 4 bends into an S shape, as shown in FIG. 3. FIG. 4 shows the conditions when the tip of the foot is placed under load. FIGS. 2, 3 and 4 show the stages in running of foot tilting.

In principle, conditions do not change if the one end of the leaf spring 4 is connected to the rear part of the upper sole 1 and the other end of the leaf spring 4 is connected to the front part of the lower sole 3. A shoe which is constructed in this manner is one according to the invention and functions in exactly the same way as the one shown in FIG. 1.

Figure 8:
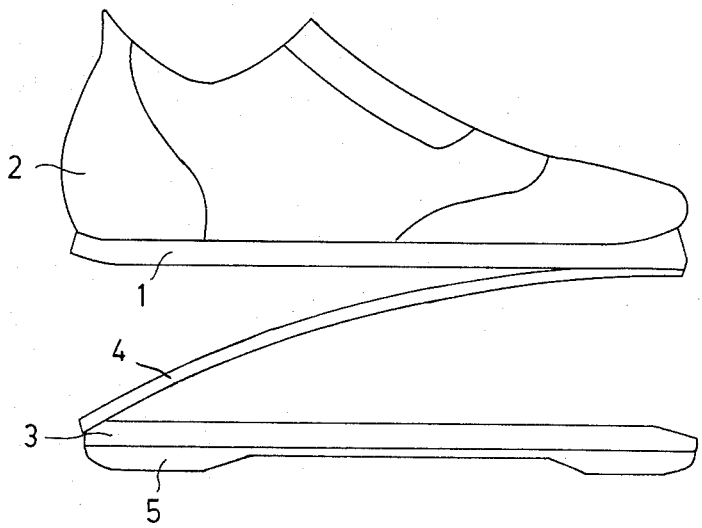

The two soles 1 and 3 need not be parallel to each other when not under load. By a slight front upward tilt position of the upper sole 1, it is possible to increase the take-off power at the expense of the heel thrust, while with a slight front downward tilt position, the reverse is true. In the unloaded condition, the leaf spring 4 may be flat, as shown in FIG. 1, or else arched or S-shaped. The ratio of heel thrust to foot-tip thrust can be influenced by the spring curvature even in the case of parallel soles 1 and 3. In FIG. 8, for example, leaf spring 4 is curved in an arcuate shape having a constant curvature for producing a desired ratio of heel thrust to foot-tip thrust, and soles 1 and 3 are flat and parallel.

In a running and jumping shoe according to the invention, both soles 1 and 3, or one of them, may also be elastic. If the lower sole 3, for instance, is developed as a leaf spring, it will bend in the opposite direction to the leaf spring 4 upon application of load on the foot tip, as shown in FIG. 4. Upon application of load on the heel, an elastic lower sole 3 has no effect in the case of a running and jumping shoe according to FIG. 1. The conditions are reversed if, as described in the alternative above, the leaf spring 4 is attached the other way around.

EXAMPLE 2

The loading of the leaf spring 4 in a running and jumping shoe in Example 1 is greatest just behind the attachment to the soles 1 and 3. In the case of heel loading, as shown in FIG. 2, the spring curvature is, for instance, greatest just behind the attachment to the upper sole 1. In the design of the spring, one must be guided by these critical places, and the spring therefore becomes relatively thick and heavy. The conditions can be improved slightly by a conical development of the springs with respect to the thickness or width. The thinnest place in the spring then lies in the center between the two attachments. Such springs, however, are difficult to manufacture and are therefore expensive. The leaf springs 4 can be dimensioned optimally with respect to their size and weight if one sees to it, by means of a support, that a maximum spring curvature determined by the physical properties of the material cannot be exceeded.

Figure 5:
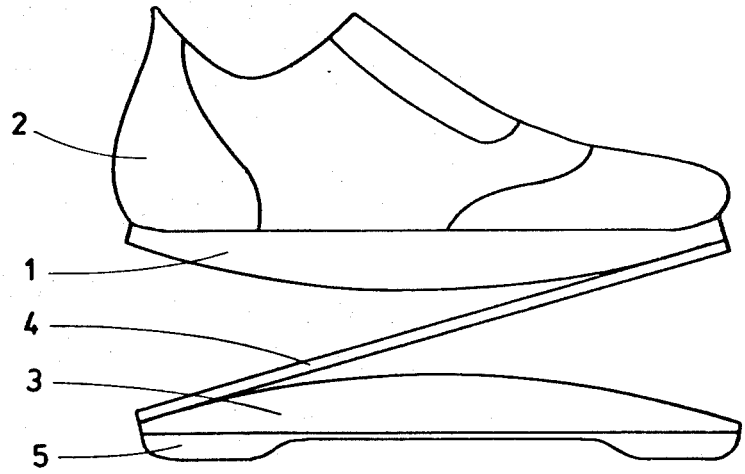
FIG. 5 is an elevational view of a second embodiment of a shoe provided with the invention.

One such running and jumping shoe in accordance with the invention is shown in FIG. 5. Both the upper sole 1 and the lower sole 3 are developed with arches on their opposed sides facing the leaf spring 4, so that the leaf spring 4 can rest against the arched soles upon the application of load. With a flat leaf spring 4 of high-grade tempered spring steel (55Si7) of 5 mm in thickness and 90 mm in width and effective length of 260 mm, a tensile strength of 1200 $N/mm^2$ is not exceeded if the curved sole parts are formed of sections of a circular path of a radius of 435 mm. These measurements correspond approximately to the conditions shown in FIG. 5. An athlete weighing 75 kg wearing such shoes presses the springs 4 together—in case of uniform standing load on both shoes—by about 11 mm, while when the shoe is loaded by the heel or the tip of the foot with 300N, and therefore with four times the weight of the body, they are pressed together by about 69 mm. In the case of about 10 times the weight of the body, the maximum possible spring path of 75 mm is reached. These values are favorable for normal long-distance running. For fast sprints, the springs must be reinforced, while for broad and high jumps, the spring path must be increased.

Due to considerations of weight, the soles 1 and 3 are not made arcuate over their entire width. It is sufficient if the leaf spring 4 can rest on both sides of the shoe against an arcuate rib. The soles are produced, for instance, as an aluminum casting and contain, in addition to the arcuate ribs, stability-increasing braces and recesses for fastening a leaf spring 4 and the athletic shoe 2 which surrounds the foot. The running and jumping shoes according to the invention which are described in this example have the further advantage over the one described in FIG. 1 of greater assurance against tilting. The possibility of twisting of the leaf springs, which must be avoided by a suitable position of the foot, is greatly reduced by its resting against the arcuate ribs.

Instead of the flat leaf springs 4 provided in this example, curved leaf springs 4 can also be used. The curvature of the soles must then be suitably adapted, and flat or even negatively curved soles may be necessary in order to make certain that the leaf springs rest with the allowable tension.

Materials useful for the arched soles include the aluminum described, but light materials of high stiffness and breaking strength are preferred. Fiber-reinforced plastics satisfy these requirements and can be worked inexpensively into complicated shapes.

EXAMPLE 3

Figure 6:
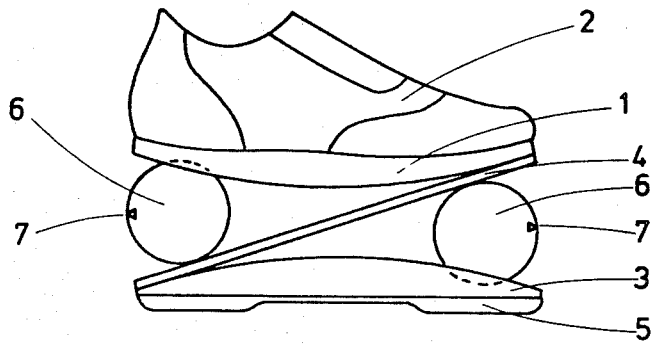
FIG. 6 is an elevational view of a third embodiment thereof.

Up to now the simplest possible examples have been described. However, the leaf springs 4 can also be developed with a multiplicity of steps such as is customary, for instance, in the case of automobile springs. Additional springs of another type may also be used. For example, it is advantageous to use separate pneumatic springs 6 in the front and rear parts of the shoe, as shown in FIG. 6. If the pneumatic springs 6 are inflatable by means of a valve 7, the spring force can be adapted to the estimated stresses by different degrees of inflation.

EXAMPLE 4

Figure 7:
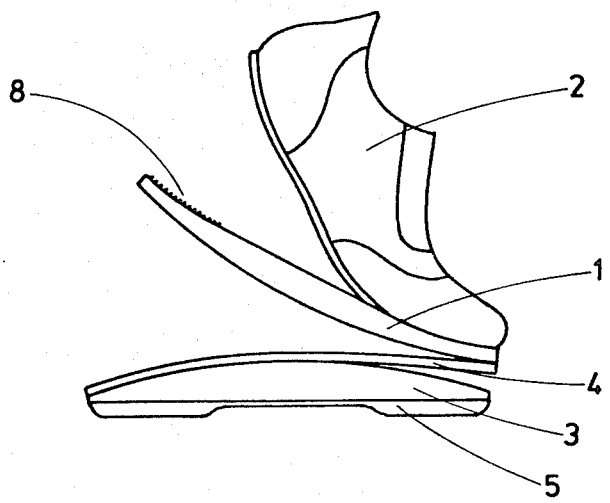
FIG. 7 is an elevational view of a fourth embodiment thereof.

In Examples 1 to 3, a substantially rigid upper sole 1 has been used which is identical to a shoe sole. However, for dependable running and jumping with shoes in accordance with the invention, it is also sufficient if dependable guidance of the spring 4 and the lower sole 3 is assured by the connecting of the front of the shoe to the leaf spring 4. FIG. 7 shows an embodiment of a running and jumping shoe according to the invention in which only the front part of the athletic shoe 2 surrounding the foot is firmly connected to the sole 1. In order to make this clear, FIG. 7 shows the shoe with loading of the front of the foot as in FIG. 4. The rear part of the shoe is in this case lifted off from the upper sole 1 with the toes bent. The take-off behavior is improved, as compared with Examples 1 to 3, and corresponds to running with normal athletic shoes. Upon the setting down of the heel and upon the rolling of the foot during the running motion, the rear part of the shoe touches the upper sole 1. The lifting-off commences only upon the forward thrust with the point of the foot. Very similar conditions are found in cross-country skiing and all devices and measures known in the latter can be adopted here. Thus, it is advisable to provide in the region of the heel on the side of the upper sole 1 facing the shoe 2 a covering 8 forming points, which assures good adherence between shoe sole and upper sole 1. The connecting of the front of the shoe to the leaf spring 4 can also be effected by a swivel joint which is located in the region of the toes or at the tip of the foot.

The Examples indicated above cannot exhaustively describe all advantageous embodiments of running and jumping shoes in accordance with the invention. Only shoes have been described in which the athletic shoe 2 which covers the foot forms a single unit with the other parts of the shoe 1, 3 and 4. However, a running and jumping shoe in accordance with the invention could be provided, in which a normal athletic shoe having a separate lower part comprising an upper sole 1, a lower sole 3 and a leaf spring 4 is attached by a shoe harness which is similar to that used in cross-country skiing.

One advisable addition is to provide protection against dirtying of the leaf springs 4 and of the arcuate guide ribs. This protection can be obtained, for instance, by a rubber sleeve which connects the edges of the two soles 1 and 3 to each other.

It is possible to improve the reliability against tilting by devices which assure substantial parallel guidance of the edges of the soles. This is done, for instance, by scissor-like lever arrangements (not shown) as additional connections between the upper and lower soles.

High-grade tempered spring steel is preferred as the material for the leaf springs, but spring bronzes, fiber-reinforced plastics and other spring materials also may be satisfactory. A flat shape leaf spring with uniform thickness and width is preferred since it is cheapest. However, other forms of leaf springs, for instance curved or S-shaped, also enter into consideration. In case of high loads, multiple springs are advantageous.

The width of the spring 4 corresponds approximately to the width of the shoe. Its length is generally slightly greater than the length of the shoe. For taking up larger forces, wider springs 4 are suitable. With longer springs 4, greater spring paths can be provided. Longer spring paths can also be obtained by mounting a plurality of the arrangements in accordance with the invention described above one above the other so that the running and jumping shoe of the invention contains two or more leaf springs 4 and one or more intermediate soles, which can also be reduced to fastening elements which connect the ends of two leaf springs together.

Although the present invention has been described in connection with a number of preferred embodiments thereof, many variations and modifications will now become apparent to those skilled in the art. It is preferred, therefore, that the present invention be limited not by the specific disclosure herein, but only by the appended claims.

What is claimed is:

1. A spring-action athletic shoe comprising a shoe to be worn on the foot; an upper sole attached beneath the shoe; a lower sole spaced separate from and beneath the upper sole; the upper sole and the lower sole both having a front and rear end generally at the front and rear ends of the shoe; and both ends of said lower sole are adapted for being pressed upon the ground as the shoe is used;

a leaf spring for elastically connecting the upper and lower soles; the leaf spring being generally of the width of the shoe; the leaf spring having one end attached to one of the front and rear of the upper sole and having an opposite other end which is attached to the other of the front and rear of the lower sole.

2. The athletic shoe of claim 1, wherein the one end of the leaf spring is attached at the front of the upper sole and the other end of the leaf spring is attached at the rear of the lower sole.

3. A spring-action athletic shoe comprising a shoe to be worn on the foot; an upper sole attached beneath the shoe; a lower sole spaced from and beneath the upper sole; the upper sole and the lower sole both having a front and rear end generally at the front and rear ends of the shoe; and both ends of said lower sole are adapted for being pressed upon the ground as the shoe is used;

a leaf spring for elastically connecting the upper and lower soles; the leaf spring being generally of the width of the shoe; the leaf spring having one end attached to one of the front and rear of the upper sole and having an opposite other end which is attached to the other of the front and rear of the lower sole;

the upper sole and the lower sole having respective opposite surfaces which face toward the leaf spring between them; at least one of the facing surfaces of the upper sole and the lower sole being at least partially arched in shape for the leaf spring to rest thereagainst in the region of greatest spring curvature upon loading.

4. The athletic shoe of claim 3, wherein the facing surfaces of both the upper sole and the lower sole are arched.

5. A spring-action athletic shoe comprising a shoe to be worn on the foot; an upper sole attached beneath the shoe; a lower sole spaced from and beneath the upper sole; the upper sole and the lower sole both having a front and rear end generally at the front and rear ends of the shoe; and a leaf spring for elastically connecting the upper and lower soles; the leaf spring being generally of the width of the shoe; the leaf spring having one end attached to one of the front and rear of the upper sole and having an opposite other end which is attached to the other of the front and rear of the lower sole;

the upper sole and the lower sole having respective opposite surfaces which face toward the leaf spring between them; at least one of the facing surfaces of the upper sole and the lower sole is at least partially arcuate in shape for the leaf spring to rest thereagainst upon loading; the arcuate shape of the soles being of a constant curvature.

6. A spring-action athletic shoe comprising a shoe to be worn on the foot; an upper sole attached beneath the shoe; a lower sole spaced from and beneath the upper sole; the upper sole and the lower sole both having a front and rear end generally at the front and rear ends of the shoe; and both ends of said lower sole are adapted for being pressed upon the ground as the shoe is used;

a leaf spring for elastically connecting the upper and lower soles; the leaf spring being generally of the width of the shoe; the leaf spring having one end attached to one of the front and rear of the upper sole and having an opposite other end which is attached to the other of the front and rear of the lower sole; the leaf spring being curved in an arcuate shape.

7. A spring-action athletic shoe comprising a shoe to be worn on the foot; an upper sole attached beneath the shoe; a lower sole spaced from and beneath the upper sole; the upper sole and the lower sole both having a front and rear end generally at the front and rear ends of the shoe; and a leaf spring for elastically connecting the upper and lower soles; the leaf spring being generally of the width of the shoe; the leaf spring having one end attached to one of the front and rear of the upper sole and having an opposite other end which is attached to the other of the front and rear of the lower sole; the leaf spring being curved in an arcuate shape having a constant curvature.

8. A spring-action athletic shoe comprising a shoe to be worn on the foot; an upper sole attached beneath the shoe; a lower sole spaced from and beneath the upper sole; the upper sole and the lower sole both having a front and rear end generally at the front and rear ends of the shoe; and a leaf spring for elastically connecting the upper and lower soles; the leaf spring being generally of the width of the shoe; the leaf spring having one end attached to one of the front and rear of the upper sole and having an opposite other end which is attached to the other of the front and rear of the lower sole;

the upper sole being firmly attached to the shoe only toward the front of the shoe and being detached from the remaining length of the shoe.

9. A spring-action athletic shoe comprising a shoe to be worn on the foot; an upper sole attached beneath the shoe; a lower sole spaced from and beneath the upper sole; the upper sole and the lower sole both having a front and rear end generally at the front and rear ends of the shoe; and a leaf spring for elastically connecting the upper and lower soles; the leaf spring being generally of the width of the shoe; the leaf spring having one end attached to one of the front and rear of the upper sole and having an opposite other end which is attached to the other of the front and rear of the lower sole;

the upper sole being attached to the shoe at a joint.

10. The athletic shoe of claim 1, further comprising additional spring means disposed between the upper and lower soles.

* * * * *